US010030908B2

(12) United States Patent
Lee et al.

(10) Patent No.: US 10,030,908 B2
(45) Date of Patent: Jul. 24, 2018

(54) NATURAL GAS LIQUEFACTION PROCESS

(75) Inventors: Sang Gyu Lee, Seoul (KR); Kun Hyung Choe, Seoul (KR); Young Myung Yang, Ansan-si (KR); Chul Gu Lee, Ansan-si (KR); Kyu Sang Cha, Seoul (KR); Chang Won Park, Incheon (KR); Sung Hee Choi, Incheon (KR); Yeong Beom Lee, Seoul (KR)

(73) Assignee: KOREA GAS CORPORATION, Gyeonggi-Do (KR)

( * ) Notice: Subject to any disclaimer, the term of this patent is extended or adjusted under 35 U.S.C. 154(b) by 346 days.

(21) Appl. No.: 13/806,372

(22) PCT Filed: Aug. 11, 2011

(86) PCT No.: PCT/KR2011/005889

§ 371 (c)(1),
(2), (4) Date: Dec. 21, 2012

(87) PCT Pub. No.: WO2012/023752

PCT Pub. Date: Feb. 23, 2012

(65) Prior Publication Data

US 2013/0133362 A1 May 30, 2013

(30) Foreign Application Priority Data

Aug. 16, 2010 (KR) ..... 10-2010-0078902
Nov. 23, 2010 (KR) ..... 10-2010-0116590
Apr. 12, 2011 (KR) ..... 10-2011-0033526

(51) Int. Cl.
*F25J 1/02* (2006.01)
*F25J 1/00* (2006.01)

(52) U.S. Cl.
CPC ..... *F25J 1/0022* (2013.01); *F25J 1/0055* (2013.01); *F25J 1/0057* (2013.01); *F25J 1/0212* (2013.01);
(Continued)

(58) Field of Classification Search
CPC ..... F25J 1/0022; F25J 1/0057; F25J 1/0055; F25J 1/0212; F25J 1/0215; F25J 1/0291;
(Continued)

(56) References Cited

U.S. PATENT DOCUMENTS 4,901,533 A * 2/1990 Fan et al. ..... 62/614
5,657,643 A 8/1997 Price
(Continued)

FOREIGN PATENT DOCUMENTS

CN 101413749 A 4/2009
JP 11-311480 11/1998
(Continued)

OTHER PUBLICATIONS

International Search Report for International Application No. PCT/KR2011/005889 dated Mar. 9, 2012.
(Continued)

*Primary Examiner* — Brian King
(74) *Attorney, Agent, or Firm* — Brinks Gilson & Lione

(57) ABSTRACT

Disclosed herein is a natural gas liquefaction process using a single refrigeration cycle adopting a mixed refrigerant, and therefore having a simple structure and thus a compact system which is easy to operate, and further, after the mixed refrigerant is separated into two refrigerant parts, the two refrigerant parts are not mixed with each other but go through condensing (cooling), expanding, heat-exchanging, and compressing stages individually, and thus, optimal temperature and pressure conditions are applied to each of the separated refrigerant parts to increase efficiency of the liquefaction process.

22 Claims, 10 Drawing Sheets

(52) U.S. Cl.
CPC ..... *F25J 1/0214* (2013.01); *F25J 1/0215* (2013.01); *F25J 1/0291* (2013.01); *F25J 1/0294* (2013.01); *F25J 2270/90* (2013.01)

(58) Field of Classification Search
CPC ..... F25J 1/0294; F25J 1/0214; F25J 2270/90; F25J 2270/902
See application file for complete search history.

(56) References Cited

U.S. PATENT DOCUMENTS

| | | | | |
|---|---|---|---|---|
| 6,105,389 | A | 8/2000 | Paradowski et al. | |
| 6,427,483 | B1 * | 8/2002 | Rashad | F25B 9/006 62/613 |
| 2009/0217701 | A1 * | 9/2009 | Minta | F25J 1/0022 62/612 |
| 2009/0277218 | A1 | 11/2009 | Kevenaar et al. | |
| 2010/0186445 | A1 * | 7/2010 | Minta | F25J 1/0022 62/606 |
| 2010/0319396 | A1 * | 12/2010 | Dam | F25J 1/0022 62/613 |

FOREIGN PATENT DOCUMENTS

| | | | |
|---|---|---|---|
| JP | 4494542 | B2 | 6/2010 |
| KR | 1020060039291 | A | 5/2006 |
| KR | 1020060039292 | A | 5/2006 |
| KR | 10-2008-0109090 | A | 11/2008 |
| KR | 101009853 | B1 | 1/2011 |
| KR | 101009892 | B1 | 1/2011 |

OTHER PUBLICATIONS

Notification of the Recording of a Change for International Application No. PCT/KR2011/005889 dated Nov. 2, 2012.

* cited by examiner

【FIG. 1】
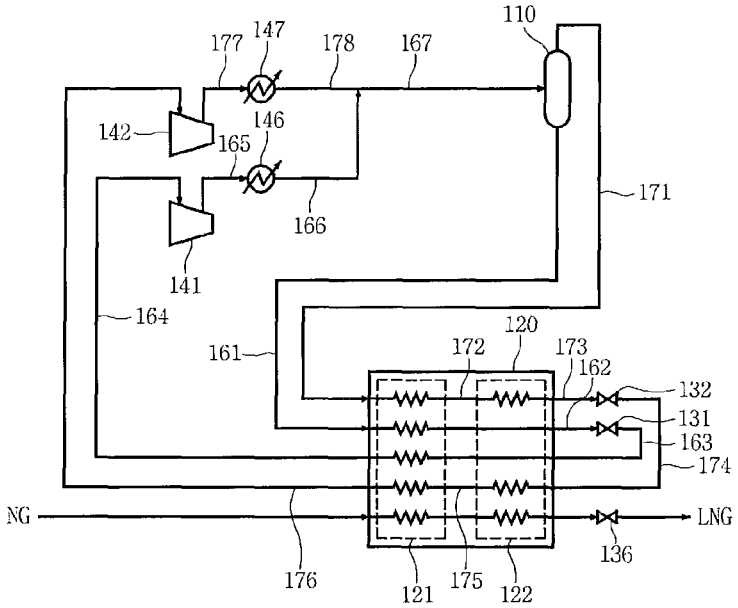
【FIG. 2】
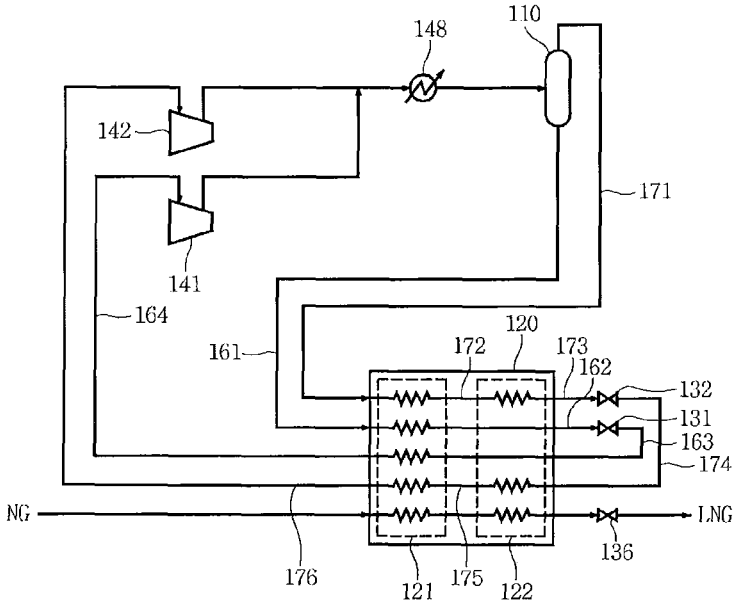

【FIG. 3】
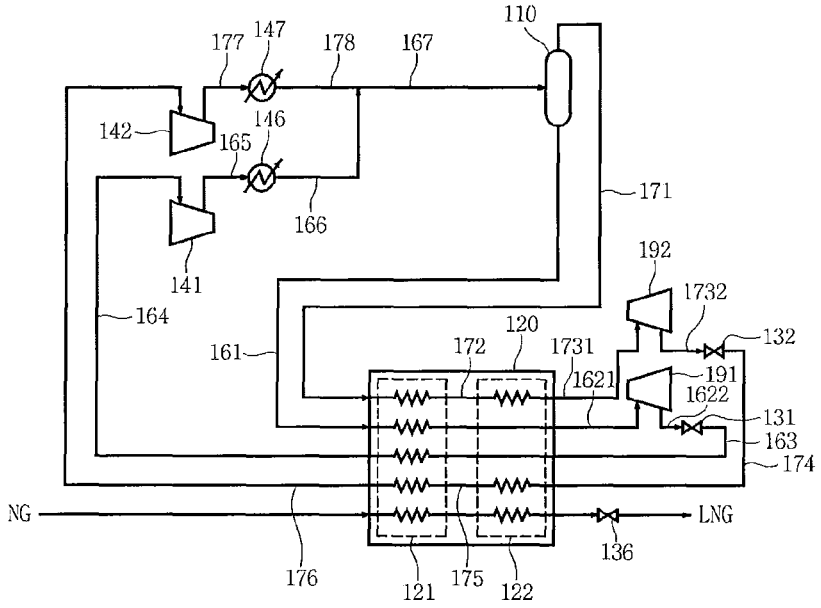
【FIG. 4】
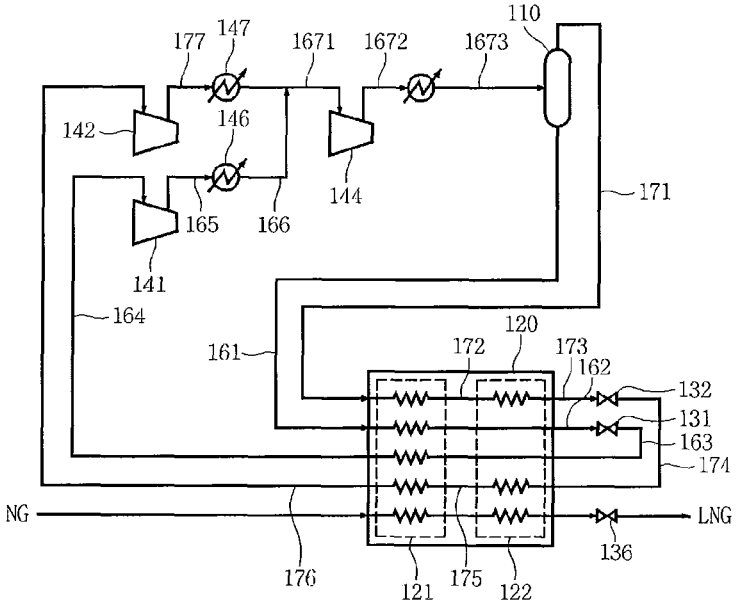

【FIG. 5】
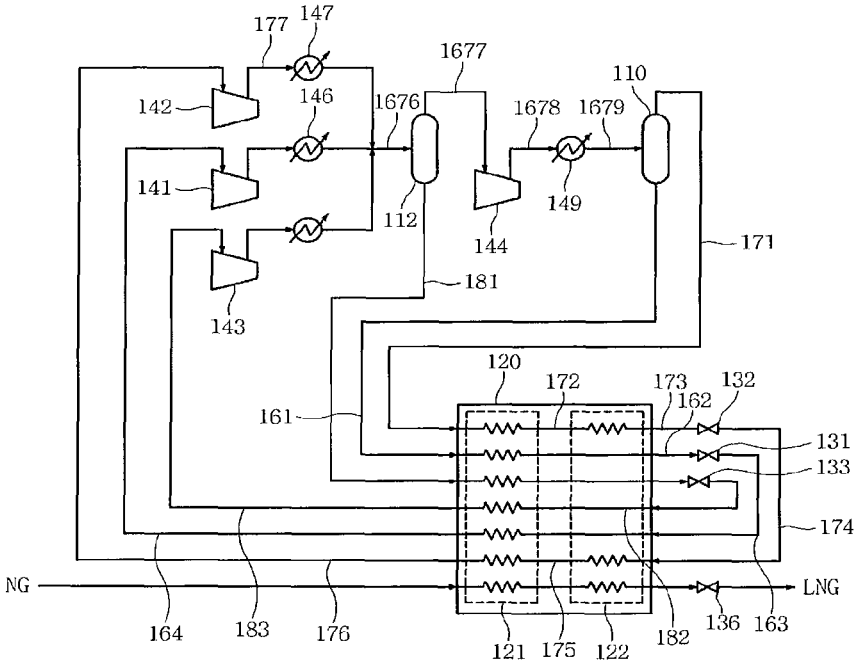
【FIG. 6】
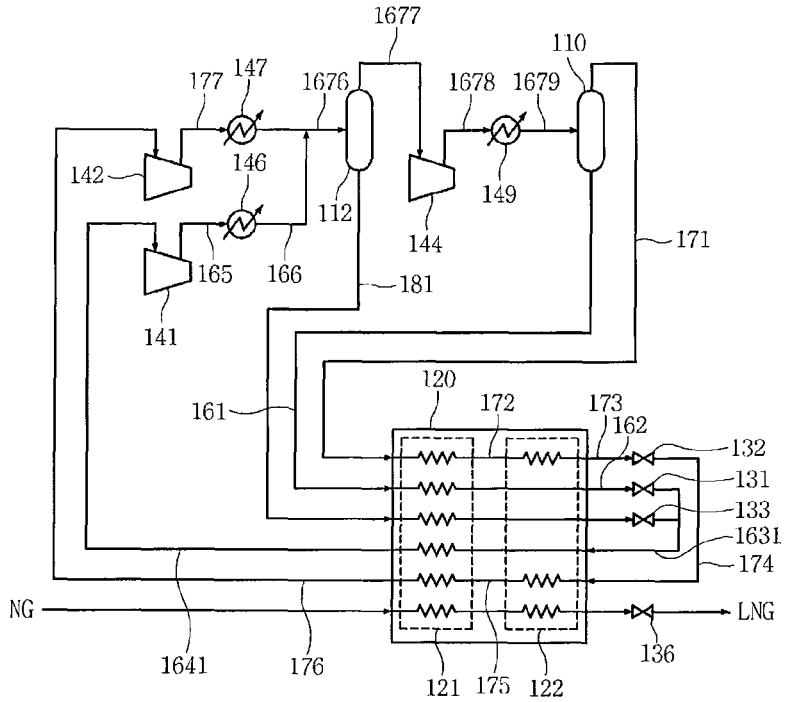

【FIG. 7】
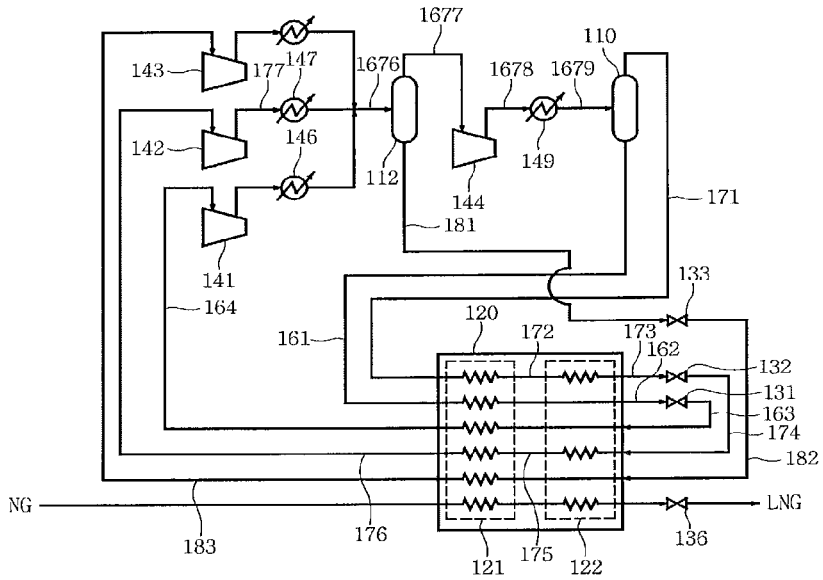
【FIG. 8】
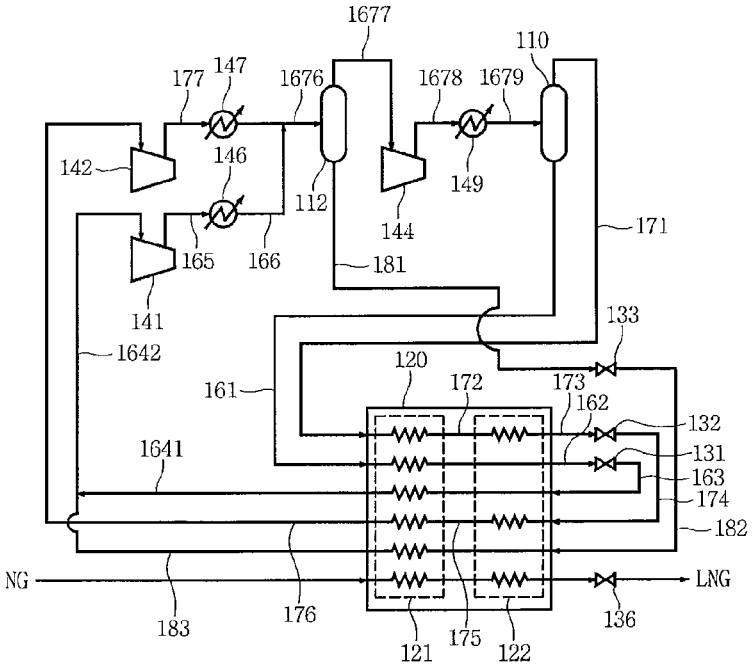

【FIG. 9】
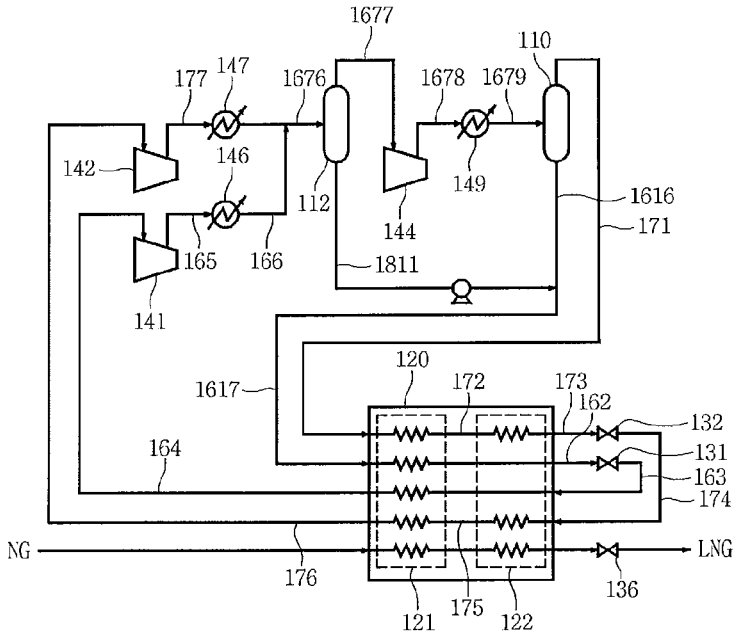
【FIG. 10】
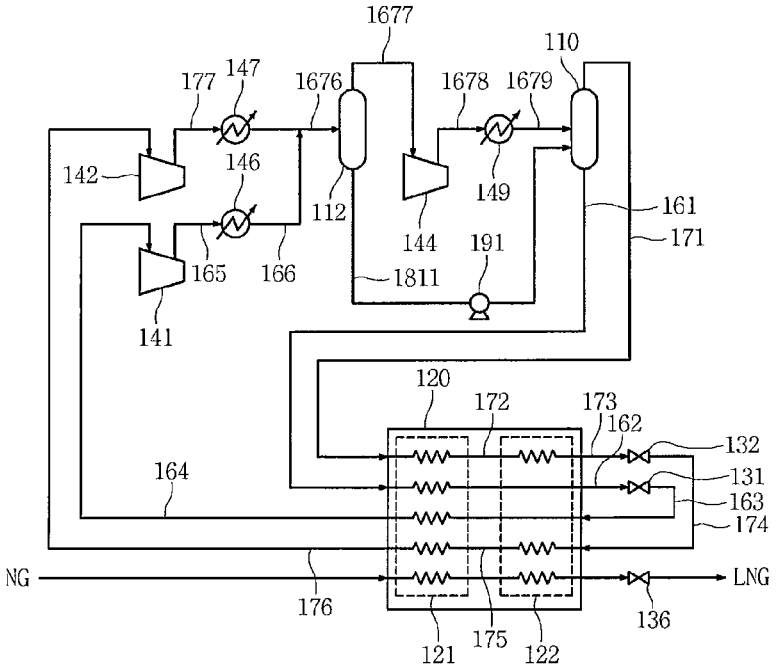

【FIG. 11】
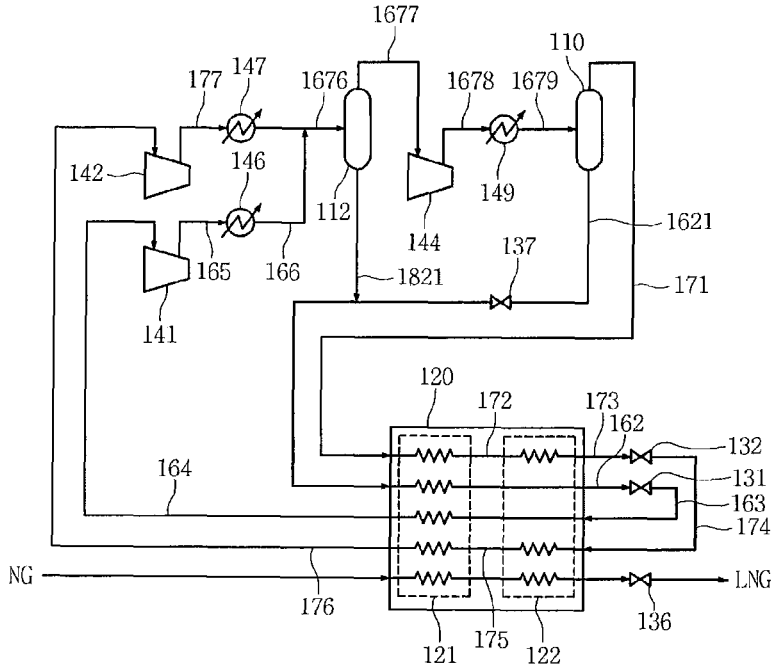
【FIG. 12】
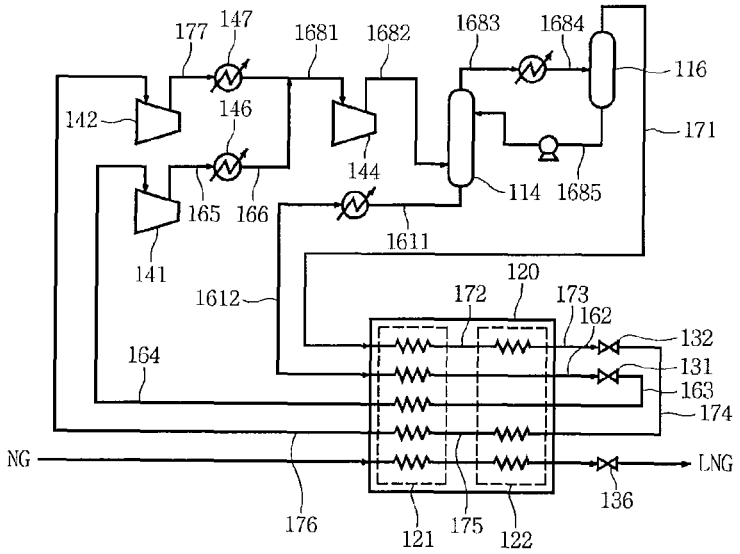

【FIG. 13】
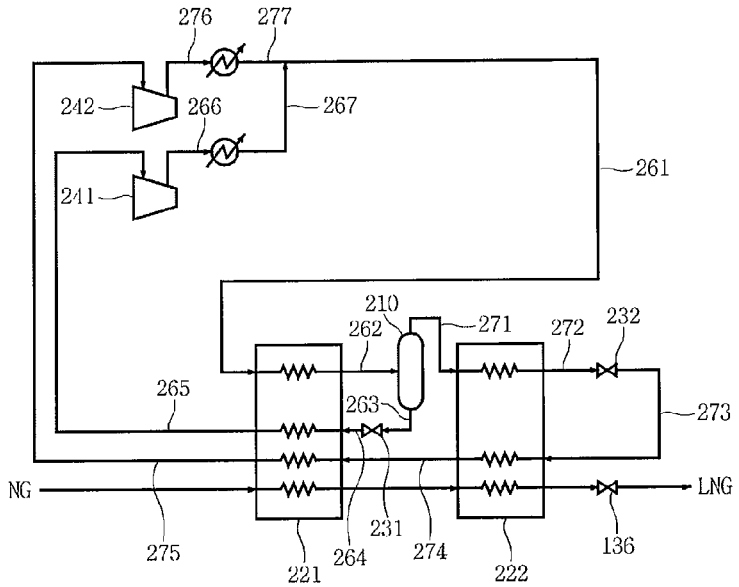
【FIG. 14】
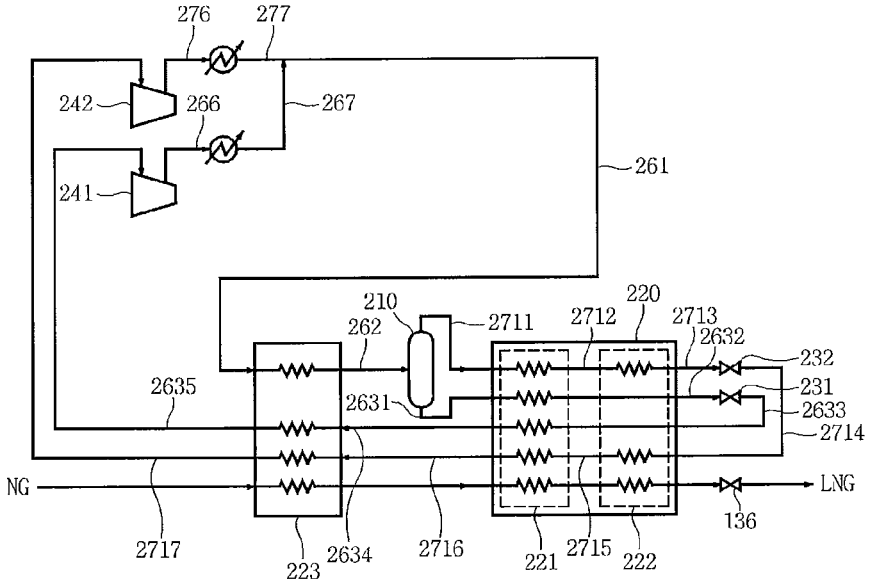

【FIG. 15】
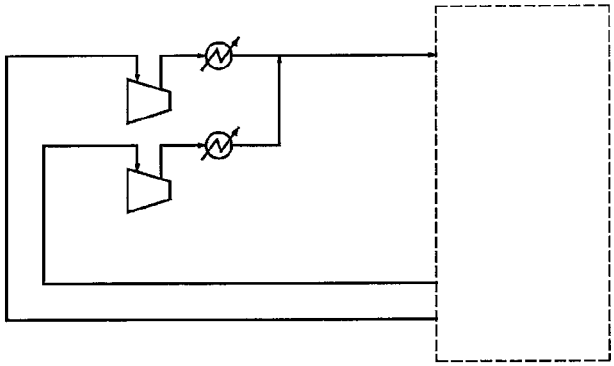
【FIG. 16】
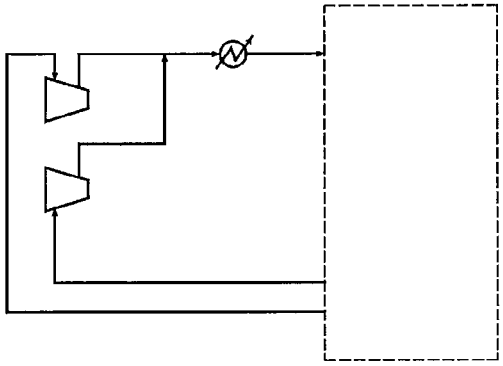

【FIG. 17】
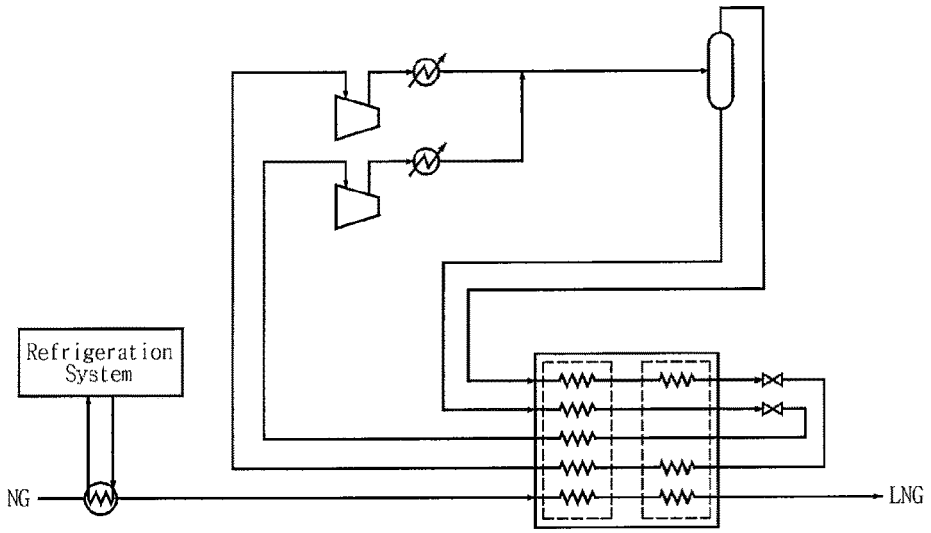
【FIG. 18】
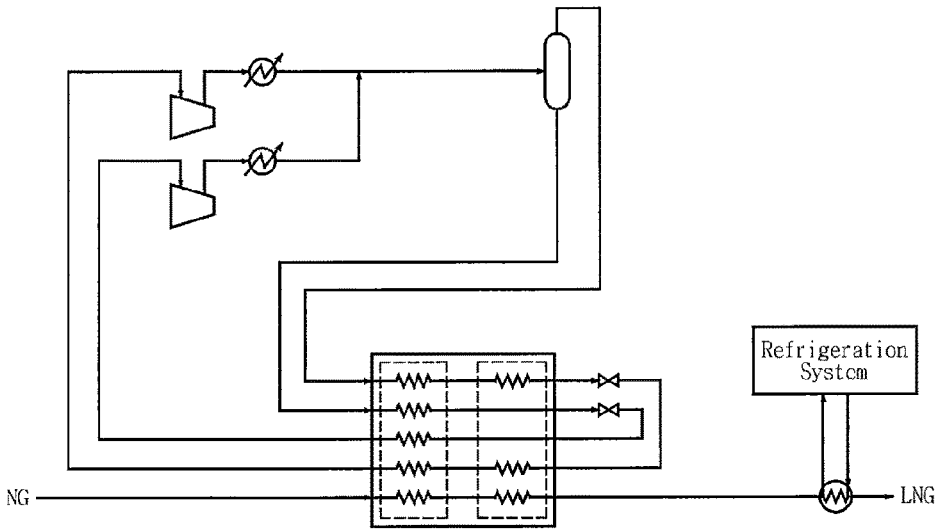

【FIG. 19】
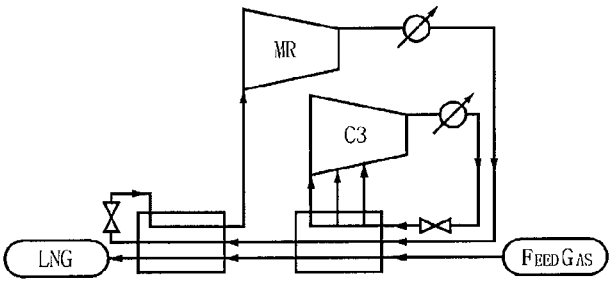
【FIG. 20】
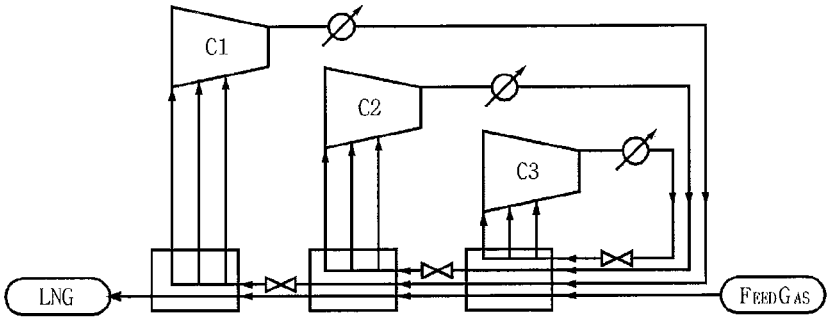
【FIG. 21】
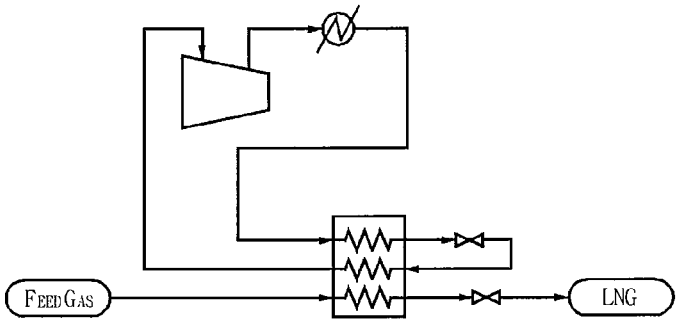

NATURAL GAS LIQUEFACTION PROCESS

This application is a National Stage of International Application PCT/KR2011/005889 filed Aug. 11, 2011, which claims the benefit of the filing dates of Korean Patent Application Serial No. KR 10-2011-0033526, filed Apr. 12, 2011, Korean Patent Application Serial No. KR 10-2010-0116590 filed Nov. 23, 2010, and Korean Patent Application Serial No. KR 10-2010-0078902, filed Aug. 16, 2010. The entirety of all applications is hereby incorporated by reference.

TECHNICAL FIELD

The present invention relates to a natural gas liquefaction process, and more particularly, to a natural gas liquefaction process having a simple structure and thus a compact system, easy operation of a liquefaction system, and improving efficiency of a liquefaction process, by using a single closed-loop refrigeration cycle adopting a mixed refrigerant.

BACKGROUND ART

A thermodynamic process by which natural gas is liquefied to produce liquefied natural gas (LNG) has been developed to meet various needs including higher efficiency and higher capability since 1970s. In order to meet these needs, that is, in order to increase efficiency and capability of a liquefaction process, various attempts to liquefy natural gas by using different refrigerants or different cycles have been continuously made until now. However, the number of liquefaction processes practically applied is very small.

The 'propane pre-cooled mixed refrigerant process (or C3/MR process)' is one of the most widely used liquefaction processes up and running. The basic structure of the C3/MR process is shown in FIG. 19. As shown in FIG. 19, a feed gas is pre-cooled to approximately 238K by a multi-stage of propane (C3) Joule-Thomson (JT) cycle. The pre-cooled feed gas is liquefied to 123K and sub-cooled, through heat exchange with a mixed refrigerant (MR) in a heat exchanger. The foregoing C3/MR process employs a refrigeration cycle adopting a single refrigerant and a refrigeration cycle adopting a mixed refrigerant, but this causes the liquefaction process to be complicated and the liquefaction system to be difficult to operate.

Another successful liquefaction process up and running is by 'Conoco Phillips' Company, and is based on a cascade process. As conceptually shown in FIG. 20, the liquefaction process by the 'Conoco Phillips' Company is composed of three Joule-Thomson cycles using methane (C1), ethylene (C2), and propane (C3), which are pure-component refrigerants. Since this liquefaction process does not use a mixed refrigerant, the operation of the liquefaction process is stable, simple, and reliable. However, a compressor, a heat exchanger, and the like are needed for each of three cycles, and thus the size of the liquefaction system needs to be increased.

Still another successful liquefaction process up and running is the 'single mixed refrigerant process (or an SMR Process)'. The basic structure of the SMR process is shown in FIG. 21. As shown in FIG. 21, the feed gas is liquefied through heat exchange with a mixed refrigerant in a heat exchange region. In order to achieve this, a single closed-loop refrigeration cycle adopting a mixed refrigerant is used in the SMR process. In this refrigeration cycle, the mixed refrigerant is compressed and cooled, and the mixed refrigerant is condensed through heat exchange in the heat exchange region, and then expanded. The expanded refrigerant again flows into the heat exchange region, to condense the pre-cooled mixed refrigerant and liquefy the feed gas. This SMR process has a simple structure and thus a compact system, but efficiency of the liquefaction process may not be unfavorable.

DISCLOSURE

Technical Problem

Accordingly, the present invention has been made to solve the above-mentioned problems occurring in the prior art while advantages achieved by the prior art are maintained intact.

One subject to be achieved by the present invention is to provide a natural gas liquefaction process having a simple structure and thus a compact system, easy operation of a liquefaction system, and improving efficiency of a liquefaction process, by using a single closed-loop refrigeration cycle adopting a mixed refrigerant.

Technical Solution

In one aspect of the present invention, there is provided a natural gas liquefaction process where natural gas is pre-cooled through heat exchange with a refrigerant in a first heat exchange region and the pre-cooled natural gas is liquefied through heat exchange with a refrigerant in a second heat exchange region by using a single closed-loop refrigeration cycle adopting a mixed refrigerant, the closed-loop refrigeration cycle comprising: separating a partially condensed mixed refrigerant into a liquid phase refrigerant part and a gas phase refrigerant part; pre-cooling the natural gas in the first heat exchange region by using the liquid phase refrigerant part; liquefying the pre-cooled natural gas in the second heat exchange region by using the gas phase refrigerant part; firstly compressing the refrigerant part which pre-cools the natural gas through the pre-cooling; secondly compressing the refrigerant part which liquefies the natural gas through the liquefying; and mixing the refrigerant parts respectively compressed through the first compressing and the second compressing, wherein the liquid phase refrigerant part and the gas phase refrigerant part, after being separated through the separating, pass through independent loops without being mixed with each other, and then are mixed with each other in the mixing.

Advantageous Effects

As set forth above, the natural gas liquefaction process according to the present invention uses a single closed-loop refrigeration cycle adopting a mixed refrigerant, and therefore, has a simple structure and thus a compact system, and easy operation of a liquefaction system. Further, after the mixed refrigerant is separated into two refrigerant part, the two refrigerant parts are not mixed with each other but go through condensing (cooling), expanding, heat-exchanging, and compressing stages individually, and thus, optimal temperature and pressure conditions could be applied to each of the separated refrigerant parts, to thereby increase efficiency of the liquefaction process.

DESCRIPTION OF DRAWINGS

The above and other objects, features and advantages of the present invention will be more apparent from the following detailed description taken in conjunction with the accompanying drawings, in which:

FIG. 1 is a diagram illustrating a natural gas liquefaction process according to a first exemplary embodiment of the present invention;

FIG. 2 is a diagram illustrating a first modification of the natural gas liquefaction process shown in FIG. 1;

FIG. 3 is a diagram illustrating a second modification of the natural gas liquefaction process shown in FIG. 1;

FIG. 4 is a diagram illustrating a third modification of the natural gas liquefaction process shown in FIG. 1;

FIG. 5 is a diagram illustrating a natural gas liquefaction process according to a second exemplary embodiment of the present invention;

FIG. 6 is a diagram illustrating a first modification of the natural gas liquefaction process shown in FIG. 5;

FIG. 7 is a diagram illustrating a second modification of the natural gas liquefaction process shown in FIG. 5;

FIG. 8 is a diagram illustrating a third modification of the natural gas liquefaction process shown in FIG. 5;

FIG. 9 is a diagram illustrating a fourth modification of the natural gas liquefaction process shown in FIG. 5;

FIG. 10 is a diagram illustrating a fifth modification of the natural gas liquefaction process shown in FIG. 5;

FIG. 11 is a diagram illustrating a sixth modification of the natural gas liquefaction process shown in FIG. 5;

FIG. 12 is a diagram illustrating a natural gas liquefaction process according to a third exemplary embodiment of the present invention;

FIG. 13 is a diagram illustrating a natural gas liquefaction process according to a fourth exemplary embodiment of the present invention;

FIG. 14 is a diagram illustrating a modification of the natural gas liquefaction process shown in FIG. 13;

FIGS. 15 and 16 are diagrams showing basic concepts representing the above-mentioned exemplary embodiments;

FIGS. 17 and 18 are diagrams illustrating cases where the liquefaction processes according to the above-mentioned exemplary embodiments are used as parts of the entire liquefaction process, respectively;

FIG. 19 is a diagram conceptually illustrating a C3/MR process of the prior art;

FIG. 20 is a diagram conceptually illustrating a cascade process of the prior art; and FIG. 21 is a diagram conceptually illustrating an SMR process of the prior art.

BEST MODE

Hereinafter, exemplary embodiments of the present invention will be described in detail with reference to the accompanying drawings. However, the present invention is not limited to these exemplary embodiments. For reference, the reference numerals will be used to describe substantially the same components. Under this rule, a description may be provided while citing contents shown in other drawings and contents well-known to those skilled in the art or a repeated content may be omitted.

First Exemplary Embodiment

FIG. 1 is a diagram illustrating a natural gas liquefaction process according to a first exemplary embodiment of the present invention. The liquefaction process according to the present exemplary embodiment, as shown in FIG. 1, may be applied to a process where a single closed-loop refrigeration cycle is used to cool natural gas to the liquefaction temperature, thereby producing liquefied natural gas (LNG). In particular, the liquefaction process according to the present exemplary embodiment may be applied to a natural gas liquefaction process where the natural gas is pre-cooled through heat exchange with a refrigerant in a first heat exchange region and the pre-cooled natural gas is liquefied through heat exchange with a refrigerant in a second heat exchange region, by using a single closed-loop refrigeration cycle adopting a mixed refrigerant or a multi-component refrigerant. In addition, the liquefaction process according to the present exemplary embodiment may include a separate auxiliary refrigeration cycle to cool the mixed refrigerant additionally or to cool the natural gas once more.

Hereinafter, the liquefaction process according to an exemplary embodiment of the present invention that is applied to a natural gas liquefaction process including a single refrigeration cycle will be described with reference to FIG. 1. A partially condensed mixed refrigerant flows into a separating unit 110 and then is separated into a first refrigerant part and a second refrigerant part having a lower boiling point than the first refrigerant part, depending on the difference in boiling point. That is, the partially condensed mixed refrigerant may be separated into the first refrigerant part separated as a liquid phase refrigerant part due to its higher boiling point and the second refrigerant part separated as a gas phase refrigerant part due to its lower boiling point by the separating unit 110. The separating unit 110 may be a normal vapor-liquid separator.

The thus separated first refrigerant part goes through a series of cooling process and expanding process, and then may pre-cool the natural gas in the first heat exchange region through heat exchange. Specifically, the separated first refrigerant part flows into the first heat exchange region 121 through a conduit 161 connecting between the separating unit 110 and the first heat exchange region 121. Then, the first refrigerant part is cooled through heat exchange in the first heat exchange region 121. This cooling of the refrigerant part is performed by heat exchange with refrigerants which flow into the first heat exchange region 121 through conduits 163 and 175. The thus cooled refrigerant part flows into an expanding unit 131 through a conduit 162, and then is expanded. Here, the expanding unit 131 may be a normal expansion valve.

The expanded refrigerant part again flows into the first heat exchange region 121 through the conduit 163. The refrigerant part flows into the first heat exchange region 121, to cool other refrigerants and pre-cool the natural gas through heat exchange in the first heat exchange region 121. The refrigerant part, which completes heat exchange in the first heat exchange region 121, flows into a first compressing unit 141 through a conduit 164, and then is compressed. Here, the first compressing unit 141 may be a normal compressor, and a second compressing unit 142 to be described below may also be a normal compressor. In addition, the first and second compressing units each may have a configuration where a plurality of compressors and cooling units are connected in series. When the refrigerant part is compressed in multi-stage through this configuration, the power required for the compressors may be reduced. For reference, as shown in FIG. 1, since exit sides of the first and second compressing units 141 and 142 are connected with each other, the pressures at the exit sides thereof may be equal to each other, but the pressures at the entrance sides of the first and second compressing units 141 and 142 may be different from each other.

In addition, the separated second refrigerant part flows into the first heat exchange region 121 through a conduit 171, and then is cooled. This cooling of the refrigerant part is performed by heat exchange with refrigerants which flow into the first heat exchange region 121 through the conduits 163 and 175. The cooled refrigerant part flows into the second heat exchange region 122 through a conduit 172, and then is condensed. This condensing of the refrigerant part is performed by heat exchange with refrigerant which flows into the second heat exchange region 122 through a conduit 174. The condensed refrigerant part flows into an expanding unit 132 through a conduit 173, and then is expanded. Here, the expanding unit 132 may be a normal expansion valve. The expanded refrigerant part again flows into the second heat exchange region 122 through the conduit 174, to condense other refrigerants and liquefy the pre-cooled natural gas through heat exchange. For reference, the liquefied natural gas may be expanded by an expansion valve 136, and then flow into a storage tank or the like.

The foregoing two heat exchange regions 121 and 122 may be provided in one heat exchange unit 120 as shown in FIG. 1, or may be respectively provided in two heat exchange units. In addition, the heat exchange unit may be a normal heat exchanger. In addition, for convenient showing, as shown in FIG. 1, a portion where the heat exchange is substantially performed in the heat exchange region is expressed by a shape similar to a triangular wave, and a portion where the heat exchange is not substantially performed in the heat exchange region is expressed by a straight line (in some cases, a slight heat exchange may be performed). For example, a portion expressed by the straight line within the heat exchange unit 120 of FIG. 1 does not substantially pass through the second heat exchange region 122, that is, does not perform heat exchange with other refrigerants, but is shown like as if the portion passes through the second heat exchange region 122.

The refrigerant part which completes heat exchange in the second heat exchange region 122 flows into the first heat exchange region 121 through the conduit 175, and thereby can additionally cool other refrigerants or additionally pre-cool the natural gas through heat exchange. Since the refrigerant part which cools other refrigerants and the natural gas in the second heat exchange region 122 has a sufficiently low temperature even after the heat exchange, this refrigerant part can cool other refrigerants and the natural gas even though it flows into the first heat exchange region 121 as such. The refrigerant part which completes this heat exchange flows into the second compressing unit 142 through the conduit 176, and then is compressed. However, in some cases, the refrigerant part which completes heat exchange in the second heat exchange region 122 may directly flow into the second compressing unit 142 without passing through the first heat exchange region 121.

The first refrigerant part compressed by the first compressing unit 141 and the second refrigerant part compressed by the second compressing unit 142 flow into the cooling units 146 and 147 through the conduits 165 and 177, respectively, and then are cooled, and the respective refrigerant parts may be partially condensed due to this cooling. These cooling units 146 and 147 may be normal coolers. Then, the respective refrigerant parts are mixed into a single refrigerant part by a mixing unit. This mixing unit may be a normal mixer. Alternatively, this mixing unit may mean a connection between conduits, that is, two conduits 166 and 178 which are connected with each other to induce the mixing of the first refrigerant part and the second refrigerant part, as shown in FIG. 1. The thus mixed refrigerant part flows into the separating unit 110 through a conduit 167 while being partially condensed, and then repeats the foregoing refrigeration cycle.

Meanwhile, positions of the foregoing cooling units are not limited to the positions shown in FIG. 1. That is, as shown in FIG. 1, the two cooling units 146 and 147 may be individually provided at the rear of the first and second compressing units 141 and 142 to cool the respective refrigerant parts, respectively, or alternatively, as shown in FIG. 2, there may be provided a cooling unit 148, for cooling, after the mixing of the refrigerant parts, the mixed refrigerant part. FIG. 2 is a diagram illustrating a first modification of the natural gas liquefaction process shown in FIG. 1. For reference, in the case of the exemplary embodiment shown in FIG. 1, the refrigerant parts are partially condensed due to the cooling by the cooling units 146 and 147. However, in the case of the modification shown in FIG. 2, the mixed refrigerant part is partially condensed due to the cooling by the cooling unit 148.

In addition, in the liquefaction process shown in FIG. 1, expanders may be further provided between the foregoing second heat exchange region 122 and the expanding units 131 and 132 in order to further increase efficiency of the liquefaction process, as shown in FIG. 3. FIG. 3 is a diagram illustrating a second modification of the natural gas liquefaction process shown in FIG. 1. Specifically, as shown in FIG. 3, the first refrigerant part may pass through the first heat exchange region 121 and flow into an expander 191 through a conduit 1621, and then be firstly expanded. After that, the first refrigerant part may flow into the expansion valve 131 through a conduit 1622, and then be secondly expanded. Likewise, the second refrigerant part may pass through the second heat exchange region 122 and flow into an expander 192 through a conduit 1731, and then be firstly expanded. After that, the second refrigerant part may flow into the expansion valve 132 through a conduit 1732, and then be secondly expanded.

A normal expansion valve or JT valve only serves to decrease the temperature of fluid by dropping a pressure. As compared with this, the expander generates a work to the outside as well as drops the pressure, and thus, more energy may be outputted from the fluid whereby the temperature of the fluid may be further decreased. In addition, compressors or the like may be driven through the work generated from the expander. As a result, efficiency of the entire liquefaction process can be increased, and it was confirmed that the liquefaction process shown in FIG. 3 achieved the improvement in efficiency by approximately 1.7% as compared with the liquefaction process shown in FIG. 1.

In addition, the liquefaction process shown in FIG. 1 may be modified to perform additional recompressing to the mixed refrigerant part, after the mixing of the refrigerants, as shown in FIG. 4. FIG. 4 is a diagram illustrating a third modification of the natural gas liquefaction process shown in FIG. 1. That is, as shown in FIG. 4, the mixed refrigerant part may be compressed once more by a recompressing unit 144, and the recompressed refrigerant part may be cooled once more and then partially condensed. For reference, in the case of the exemplary embodiment shown in FIG. 1, the refrigerant parts are partially condensed due to the cooling by the cooling units 146 and 147, and in the case of the modification shown in FIG. 4, the mixed refrigerant part is recompressed and recooled, and then partially condensed.

Since the liquefaction process according to the present exemplary embodiment is composed of only a single refrigeration cycle, as described above, the liquefaction process is fundamentally simple, and thus the liquefaction system is compact and is easy to operate. In addition, as described above, in the liquefaction process according to the present exemplary embodiment, the partially condensed mixed refrigerant is separated into the first refrigerant part and the second refrigerant part by the separating unit. Then, the first refrigerant part and the second refrigerant part are not mixed with each other but pass through independent loops, respectively, and then reach the mixing unit, at which the first refrigerant part and the second refrigerant part are mixed with each other. That is, there are no cross points of first conduits 161-164 that guide the first refrigerant from the separating unit 110 to the first compressing unit 141 and second conduits 171-176 that guide the second refrigerant from the separating unit 110 to the second compressing unit 142. Accordingly, in the liquefaction process according to the present exemplary embodiment, the first refrigerant and the second refrigerant individually go through condensing (cooling), expanding, heat-exchanging, and compressing processes, respectively, between the separating unit and the compressing unit.

As above, when the respective refrigerant parts individually perform the refrigeration cycle, efficiency of the liquefaction process can be increased. Specifically, when the mixed refrigerant is separated into the first refrigerant part and the second refrigerant part by the separating unit 110, the respective refrigerant parts have different compositions. Therefore, the respective refrigerant parts have different thermodynamic characteristics due to their different compositions, and as a result, the respective refrigerant parts are different conditions under which the cooling is effectively performed.

In order to give optimal heat exchange conditions to the separated refrigerant parts respectively while reflecting the foregoing characteristics, in the liquefaction process according to the present exemplary embodiment, the mixed refrigerant is separated into the first refrigerant part and the second refrigerant part and then the respective refrigerant parts go through condensing (cooling), expanding, heat-exchanging, and compressing processes, respectively, without being mixed with each other (that is, without mixing between the first refrigerant part and the second refrigerant part). For example, in order to give different and optimal pressure conditions to the respective refrigerant parts that complete heat exchange in the heat exchange regions, there are provided separate compressing units for the respective refrigerant part, with the result that the liquefaction process is designed so that the respective refrigerant parts can be heat exchanged with the natural gas in the optimal condition, whereby efficiency of the entire liquefaction process can be increased.

Meanwhile, the mixed refrigerant used in the liquefaction process according to the present exemplary embodiment preferably contains methane (C1), ethane (C2), propane (C3), butane (C4), pentane (C5), and nitrogen ($N_2$) in view of the increasing efficiency. In general, the mixed refrigerant contains methane (C1), ethane (C2), propane (C3), and nitrogen ($N_2$), but in the case where butane (C4) and pentane (C5) are further included therein, the temperature range coverable by the mixed refrigerant is widened, and thus the use of this mixed refrigerant can increase efficiency of the liquefaction process.

Second Exemplary Embodiment

FIG. 5 is a diagram illustrating a natural gas liquefaction process according to a second exemplary embodiment of the present invention. As shown in FIG. 5, the liquefaction process according to the present exemplary embodiment fundamentally has the same constitution as the liquefaction process according to the foregoing first exemplary embodiment. However, the liquefaction process according to the present exemplary embodiment is different from the liquefaction process according to the first exemplary embodiment in view of the fact that the mixed refrigerant part mixed by the mixing unit flows into a separating unit 112 through a conduit 1676 and then is additionally separated into a liquid phase refrigerant part and a gas phase refrigerant part. For reference, components identical (or corresponding) to the above-described components will be denoted by identical (or corresponding) reference numerals, and detailed descriptions thereof will be omitted.

When the liquefaction process according to the present exemplary embodiment is described based on the foregoing difference, first, the refrigerant part mixed by the mixing unit flows into an additional separating unit 112 through a conduit 1676 and then is additionally separated into a liquid phase refrigerant part and a gas phase refrigerant part. Here, the additional separating unit 112 may be a normal gas-liquid separator. The liquid phase refrigerant part separated by the additional separating unit 112 flows into the first heat exchange region 121 through a conduit 181 and then is cooled, and after, flows into an expansion valve 133 and then is expanded. The thus expanded refrigerant part again flows into the first heat exchange region 121 through a conduit 182 to additionally pre-cool the natural gas. Then, the refrigerant part additionally pre-cooling the natural gas flows into a third compressing unit 143 through a conduit 183 and then is compressed.

As such, the refrigerant parts individually compressed by the first to third compressing units 141, 142, and 143 may be mixed into a single refrigerant part by the forgoing mixing unit. In the liquefaction process according to the present exemplary embodiment, as shown in FIG. 5, after separation by the separating unit 110 and separation by the additional separating unit 112, the liquid phase refrigerant part and the gas phase refrigerant part separated by the separating unit 110, and the liquid phase refrigerant part separated by the additional separating unit 112 pass through independent loops without being mixed with one another, and then mixed with one another in the foregoing mixing.

Alternatively, the liquid phase refrigerant part separated by the additional separating unit 112 is not compressed by the separate compressing unit 143, but the liquid phase refrigerant part separated by the additional separating unit 112 may be compressed after being mixed with other refrigerant parts. That is, as shown in FIG. 6, the liquid phase refrigerant part separated by the additional separating unit 112 may flow into the first heat exchange region 121 through the conduit 181 and then be cooled, and after, flow into the expansion valve 133 and then be expanded. The thus expanded refrigerant part may be mixed with the refrigerant part, which is separated as the liquid phase refrigerant part by the separating unit 110, flows into the first heat exchange region 121 and then is cooled, and after, expanded by the expansion valve 131.

The thus mixed refrigerant part flows together as a single refrigerant flow. That is, the mixed refrigerant part again flows into the first heat exchange region 121 through a conduit 1631, to cool other refrigerants and pre-cool the natural gas. The refrigerant part that completes this heat exchange flows into the first compressing unit 141 through a conduit 1641, and then is compressed. The liquefaction process shown in FIG. 6 can decrease the number of compressing units as compared with the liquefaction process shown in FIG. 5, and thus can simplify the structure of the entire liquefaction system.

Meanwhile, the liquefaction process shown in FIG. 5 may be modified as shown in FIG. 7. FIG. 7 is a diagram illustrating a second modification of the natural gas liquefaction process shown in FIG. 5. Specifically, as shown in FIG. 7, the liquid phase refrigerant part separated by the additional separating unit 112 does not pass through the first heat exchange region 121, but may flow into the expansion valve 133 through the conduit 181, and then be expanded. The thus expanded refrigerant part flows into the first heat exchange region 121 through a conduit 182, to additionally pre-cool the natural gas. Then, the refrigerant part additionally pre-cooling the natural gas flows into a third compressing unit 143 through the conduit 183 and then is compressed.

Alternatively, the liquid phase refrigerant part separated by the additional separating unit 112 is not compressed by the separate compressing unit 143, but the liquid phase refrigerant part separated by the additional separating unit 112 may be mixed with other refrigerant parts and then compressed. That is, as shown in FIG. 8, the liquid phase refrigerant part separated by the additional separating unit 112 flows into the first heat exchange region 121 through the conduits 181 and 182, to additionally pre-cool the natural gas, and then may be mixed with other refrigerant parts, that is, refrigerant parts which are separated by the separating unit 110 and then flow into the first heat exchange region 121 through the conduit 163 while going through several procedures, to pre-cool the natural gas. The thus mixed refrigerant part flows into the first compressing unit 141 through a conduit 1642, and then is compressed. The liquefaction process shown in FIG. 8 can decrease the number of compressing units as compared with the liquefaction process shown in FIG. 7, and thus simplify the structure of the entire liquefaction system.

In addition, unlike the liquefaction processes shown in FIGS. 5 to 8, as shown in FIG. 9, the liquid phase refrigerant part separated by the additional separating unit 112 is mixed with the liquid phase refrigerant part separated by the separating unit 110, and then these refrigerant parts may be used as a single refrigerant flow. That is, as shown in FIG. 9, the liquid phase refrigerant part separated by the additional separating unit 112, through a conduit 1811, and the liquid phase refrigerant part separated by the separating unit 110, through a conduit 1616, may be mixed into a single flow, and the thus mixed refrigerant part flows into the first heat exchange region 121 through a conduit 1617 as a single refrigerant flow. In this liquefaction process, a pump may be further provided in the conduit 1811 in order to smoothly flow the refrigerant. For reference, in order to smoothly mix two refrigerant parts, it is preferable to match pressures of the two refrigerant parts to each other before the mixing. For example, as shown in FIG. 9, the pump may be used to increase the pressure of the liquid phase refrigerant part separated by the additional separating unit 112, or as shown in FIG. 11 to be described below, an expansion valve 137 may be used to decrease the pressure of the liquid phase refrigerant part separated by the separating unit 110.

In addition, as shown in FIG. 10, unlike the liquefaction process shown in FIG. 9, the liquid phase refrigerant part separated by the additional separating unit 112 may be supplied to the separating unit 110 through the conduit 1811. The separating unit 110 may separate the refrigerant part partially condensed by the cooling unit 149 and the refrigerant part supplied from the additional separating unit 112 into a liquid phase refrigerant part and a gas phase refrigerant part. In this liquefaction process, for smooth flowing of the refrigerant, a pump 191 may be further provided in the conduit 1811 connecting the separating unit 110 and the additional separating unit 112. Alternatively, unlike the above-described liquefaction processes, as shown in FIG. 11, the liquid phase refrigerant part separated by the separating unit 110 is expanded by the expansion valve 137 or the like, to thereby decrease the pressure thereof, and then mixed with the liquid phase refrigerant part separated by the additional separating unit 112. The thus mixed refrigerant part may flow as a single refrigerant flow. That is, the thus mixed refrigerant part may pre-cool the natural gas in the first heat exchange region 121, similarly to the above-described liquefaction processes.

Meanwhile, the gas phase refrigerant part separated by the additional separating unit 112 is partially condensed by going through recompressing and recondensing processes, and then flows into the separating unit 110, similarly to the liquefaction process shown in FIG. 4. That is, as shown in FIGS. 5 to 11, the gas phase refrigerant part separated by the additional separating unit 112 flows into the additional compressing unit 144 through a conduit 1677 and then is additionally compressed; flows into the cooling unit 149 through a conduit 1678 and then is partially condensed; and then flows into the separating unit 110 through a conduit 1679. For reference, this is expressed by the wording "partially compressing the gas phase refrigerant part separated by the additional separating" in claims below, but this may include a case where the gas phase refrigerant part separated by the additional separating is compressed, and cooled by a normal cooler, to thereby be partially condensed, and a case where the gas phase refrigerant part separated by the additional separating unit is additionally cooled by a separate cooling device or the like without being compressed.

Third Exemplary Embodiment

FIG. 12 is a diagram illustrating a natural gas liquefaction process according to a third exemplary embodiment of the present invention. As shown in FIG. 12, the liquefaction process according to the present exemplary embodiment is different from those of the above-described exemplary embodiments in that a distillation column is used as a separating unit. In the liquefaction process according to the present exemplary embodiment, the refrigerant part mixed by the mixing unit flows into the compressing unit 144 through a conduit 1681 and then is compressed. After being compressed as such, the refrigerant part flows into a distillation column 114 through a conduit 1682, and then precisely separated into a gas phase refrigerant part and a liquid phase refrigerant part correspondingly to the required compositions.

The liquid phase refrigerant part separated by the distillation column 114 is cooled by a normal cooling unit, and after, flows into the first heat exchange region 121 through a conduit 1612 and then is cooled. The thus cooled refrigerant part is expanded by the expansion valve 131, and again flows into the first heat exchange region 121. During this procedure, the refrigerant part can pre-cool the natural gas in the first heat exchange region 121. Resultantly, the liquid phase refrigerant part separated by the distillation column 114 performs the same function as the first refrigerant part of the above-described first exemplary embodiment.

In addition, the gas phase refrigerant part separated by the distillation column flows into a normal cooling unit through a conduit 1683 and then is partially condensed. The thus condensed refrigerant part is again separated into a gas phase refrigerant part and a liquid phase refrigerant part through a normal gas-liquid separator 116, and the thus separated gas phase refrigerant part performs the same function as the second refrigerant part of the above-described first exemplary embodiment. In addition, the separated liquid phase refrigerant part is again supplied to the distillation column 114. As such, when a low-temperature liquid phase refrigerant is supplied to the distillation column, the refrigerant part can be separated into a liquid phase refrigerant part and a gas phase refrigerant part more precisely in the distilled column. In addition, when the refrigerant part is precisely separated into two portions correspondingly to the required compositions by the distillation column, characteristics of the respective refrigerant parts can be utilized more accurately and thus, efficiency of the liquefaction process can be increased.

Fourth Exemplary Embodiment

FIG. 13 is a diagram illustrating a natural gas liquefaction process according to a fourth exemplary embodiment of the present invention. As shown in FIG. 13, the liquefaction process according to the present exemplary embodiment is different from the above-described exemplary embodiments in that the refrigerant part mixed by the mixing unit passes through a first heat exchange region 221, and then is separated into a gas phase refrigerant part and a liquid phase refrigerant part. That is, as shown in FIG. 13, the refrigerant part mixed by the mixing unit flows into the first heat exchange region 221 through a conduit 261, and then is partially condensed through heat exchange in the first heat exchange region 221. The thus condensed refrigerant part flows into a separating unit 210 through a conduit 262, and then is separated into a liquid phase refrigerant part and a gas phase refrigerant part depending on the difference in boiling point.

The separated liquid refrigerant part flows into an expansion valve 231 through a conduit 263 and then is expanded, and after, again flows into the first heat exchange region 221 through a conduit 264 to cool other refrigerants and pre-cool the natural gas. Then, the foregoing refrigerant part flows into a first compressing unit 241 through a conduit 265, and then is compressed. In addition, the separated gas phase refrigerant part flows into a second heat exchange region 222 through a conduit 271, and then is condensed. The thus condensed refrigerant part flows into an expansion valve 232 through a conduit 272, and then is expanded. After that, the foregoing refrigerant part again flows into the second heat exchange region 222 through a conduit 273, to cool other refrigerants and to liquefy the natural gas. The refrigerant part that completes heat exchange with the natural gas as described above may flow into the first heat exchange region 221 through a conduit 274, to additionally pre-cool the natural gas and other refrigerants. After completing these processes, the refrigerant part flows into the second compressing unit 242 through a conduit 275, and then is compressed.

This liquefaction process may be modified as shown in FIG. 14. Specifically, the partially condensed mixed refrigerant is separated into a gas phase refrigerant part and a liquid phase refrigerant part by the separating unit 210. The thus separated refrigerant parts, as shown in FIG. 14, pre-cool and liquefy the natural gas, like the liquefaction process according to the first exemplary embodiment. The modification shown in FIG. 14 further includes a third heat exchange region 223, differently from the above-described exemplary embodiments. The third heat exchange region 223 partially condenses the refrigerant part mixed by the mixing unit (see, the heat exchange region between the conduit 261 and the conduit 262), and preliminarily pre-cools the natural gas before pre-cooling in the first heat exchange region 221. This cooling is performed by allowing the refrigerant parts pre-cooling or liquefying the natural gas to flow into the third heat exchange region 223 through conduits 2634 or 2716 (see, a heat exchange region between the conduit 2634 and the conduit 2635, and a heat exchange region between the conduit 2716 and the conduit 2717). After this heat-exchanging, the refrigerant parts passing through the third heat exchange region 223 flow into the compressing units 241 and 242 through the conduits 2635 and 2717, respectively.

There is a common technical feature in the liquefaction processes described through the above-described exemplary embodiments. That is, all of the above-described exemplary embodiments have a technical feature that the partially condensed mixed refrigerant is separated into the first refrigerant part and the second refrigerant part by the separating unit, and then the first refrigerant part and the second refrigerant part pass through the independent loops, respectively, without being mixed with each other, and then reach the mixing unit, at which the first refrigerant part and the second refrigerant part are mixed with each other. In addition, the first refrigerant part and the second refrigerant part passing through the independent loops serve to cool and liquefy the natural gas, respectively, and the first refrigerant part and the second refrigerant part are independently compressed. This common technical feature may be expressed by a dot-lined boxy, as shown in FIG. 15 or FIG. 16.

For reference, comparison of efficiency in the liquefaction process between the above-described exemplary embodiments and the existing SMR process (see, FIG. 21) or the C3/MR process (see, FIG. 19) is shown in the table below. As summarized in the table below, considering the fact that the existing C3/MR process (see, FIG. 19) has excellent efficiency, it can be confirmed that the liquefaction processes according to the above-described exemplary embodiments have superior efficiency even with the use of a single closed-loop refrigeration cycle, like the existing SMR process (see, FIG. 21). Since the C3/MR process generally uses only nitrogen ($N_2$), methane (C1), ethane (C2), and propane (C3) as a refrigerant, comparison of performance among the exemplary embodiments, the C3/MR process, and the SMR process was conducted by using only nitrogen ($N_2$), methane (C1), ethane (C2), and propane (C3) as a refrigerant. For reference, the following comparison results are partially different in the respective processes according to how to determine components of the mixed refrigerant, how to determine the efficiency of the compressor, or the like.

TABLE 1

| Liquefaction cycle | kWh/kg LNG | Based on the existing SMR process | Based on the existing C3/MR process |
|---|---|---|---|
| The existing SMR process (see, FIG. 21) | 0.4760 | 100% | 162% |
| The existing C3/MR process (see, FIG. 19) | 0.2945 | 62% | 100% |
| Liquefaction process shown in FIG. 1 | 0.3204 | 67% | 109% |

TABLE 1-continued

| Liquefaction cycle | kWh/kg LNG | Based on the existing SMR process | Based on the existing C3/MR process |
|---|---|---|---|
| Liquefaction process shown in FIG. 7 | 0.3085 | 65% | 105% |
| Liquefaction process shown in FIG. 8 | 0.3085 | 65% | 105% |
| Liquefaction process shown in FIG. 9 | 0.3177 | 67% | 108% |
| Liquefaction process shown in FIG. 10 | 0.3281 | 69% | 111% |
| Liquefaction process shown in FIG. 11 | 0.3288 | 69% | 112% |

In addition, as described above, the liquefaction processes according to the above-described exemplary embodiments may further include a refrigeration cycle of additionally cooling the natural gas, as shown in FIGS. 17 and 18. That is, as shown in FIG. 17, the natural gas may be pre-cooled through the additional refrigeration cycle, and then the natural gas may be liquefied based on the liquefaction processes according to the above-described exemplary embodiments (FIGS. 17 and 18 each show the liquefaction process according to the above-described first exemplary embodiment, representatively). In addition, as shown in FIG. 18, the natural gas may be cooled through the liquefaction process according to the above-described exemplary embodiment, and then may be sub-cooled through the additional refrigeration cycle. Resultantly, each of the liquefaction process according to the above-described exemplary embodiments itself may be used as a single independent liquefaction process of liquefying the natural gas, but may be used as a part of the entire liquefaction process when being used together with another independent liquefaction process.

As described above, although the present invention has been described with reference to the exemplary embodiments thereof, those skilled in the art will appreciate that various modifications and alteration may be made without departing from the scope and spirit of the invention as disclosed in the accompanying claims. Therefore, the scope and spirit of the present invention should be understood only by the following claims, and all of equivalences and equivalent modifications to the claims are intended to fall within the scope and spirit of the present invention.

INDUSTRIAL APPLICABILITY

As set forth above, the present invention provides a natural gas liquefaction process that uses a single closed-loop refrigeration cycle adopting a mixed refrigerant, and therefor, has a simple structure and thus a compact system, and easy operation of a liquefaction system. Further, after the mixed refrigerant is separated into two refrigerant parts, the two refrigerant parts are not mixed with each other but go through condensing (cooling), expanding, heat-exchanging, and compressing stages individually, and thus, optimal temperature and pressure conditions could be applied to each of the separated refrigerant parts, to thereby increase efficiency of the liquefaction process, so that the present invention has industrial applicability.

The invention claimed is:

1. A natural gas liquefaction process where natural gas is pre-cooled through heat exchange with a refrigerant in a first heat exchange region and the pre-cooled natural gas is liquefied through heat exchange with a refrigerant in a second heat exchange region by using a single closed-loop refrigeration cycle adopting a mixed refrigerant, the closed-loop refrigeration cycle comprising:

firstly separating the refrigerant from a partially condensed mixed refrigerant into a first refrigerant part separated as a liquid phase refrigerant part and a second refrigerant part separated as a gas phase refrigerant part;

pre-cooling the natural gas in the first heat exchange region by using the first refrigerant part;

liquefying the pre-cooled natural gas in the second heat exchange region by using the second refrigerant part;

firstly compressing the first refrigerant part which pre-cools the natural gas through the pre-cooling;

secondly compressing the second refrigerant part which liquefies the natural gas through the liquefying; and after the respective first compressing and the second compressing, firstly mixing the respective first compressed first refrigerant part and the second compressed second refrigerant part, wherein the first refrigerant part and the second refrigerant part remain separated which respectively pass through independent loops without being mixed with each other again, until after the respective first compressing and the second compressing;

wherein the first refrigerant part and the second refrigerant part respectively passing through the independent loops prior to the respective first compression and the second compression are given to different pressure conditions reflecting different thermodynamic characteristics due to different compositions thereof.

2. The natural gas liquefaction process according to claim 1, wherein the pre-cooling includes: cooling the first refrigerant part separated through the first separating, by heat exchange in the first heat exchange region; expanding the cooled first refrigerant part; and heat-exchanging the expanded first refrigerant part and the natural gas in the first heat exchange region to cool the natural gas.

3. The natural gas liquefaction process according to claim 2, wherein the expanding includes: firstly expanding a condensed refrigerant part formed from the cooled first refrigerant part by an expander; and then secondly expanding the firstly expanded condensed refrigerant part by an expansion valve.

4. The natural gas liquefaction process according to claim 1, wherein the liquefying includes: cooling the second refrigerant part separated through the first separating, by heat exchange in the first heat exchange region; condensing the cooled second refrigerant part by heat exchange in the second heat exchange region; expanding the condensed second refrigerant part; and heat-exchanging the expanded second refrigerant part and the natural gas in the second heat exchange region to cool the natural gas.

5. The natural gas liquefaction process according to claim 4, further comprising additionally pre-cooling the natural gas in the first heat exchange region by using the second refrigerant part which completes heat exchange with the natural gas in the second heat exchange region through the heat-exchanging, wherein in the second compressing, the second refrigerant part which completes heat exchange with the natural gas in the first heat exchange region through the additional pre-cooling is compressed.

6. The natural gas liquefaction process according to claim 4, wherein the expanding includes: firstly expanding the condensed second refrigerant part by an expander; and then secondly expanding the firstly expanded second refrigerant part by an expansion valve.

7. The natural gas liquefaction process according to claim 1, further comprising: firstly cooling the first refrigerant part compressed by the first compressing to decrease a temperature thereof; and secondly cooling the second refrigerant part compressed by the second compressing to decrease a temperature thereof, wherein in the first mixing, the first and the second refrigerant parts cooled respectively through the first cooling and the second cooling are subsequently mixed with each other.

8. The natural gas liquefaction process according to claim 7, further comprising: recompressing the refrigerant formed through the first mixing; and cooling the recompressed refrigerant to be partially condensed.

9. The natural gas liquefaction process according to claim 1, further comprising cooling the refrigerant formed through the first mixing to be partially condensed.

10. The natural gas liquefaction process according to claim 1, further comprising:

secondly separating the refrigerant formed through the first mixing into a third refrigerant part separated as a liquid phase refrigerant part and a fourth refrigerant part separated as a gas phase refrigerant part;

additionally pre-cooling the natural gas in the first heat exchange region by using the third refrigerant part separated through the second separating;

further compressing the fourth refrigerant part separated through the second separating; and cooling the further compressed fourth refrigerant part to be partially condensed, wherein in the first separating, the fourth refrigerant part partially condensed through the cooling is the refrigerant that is separated into the first refrigerant part and the second refrigerant part.

11. The natural gas liquefaction process according to claim 10, further comprising secondly mixing the first refrigerant part which pre-cools the natural gas through the pre-cooling and the third refrigerant part which additionally pre-cools the natural gas through the additional pre-cooling, wherein in the first compressing, a refrigerant part formed through the second mixing is compressed.

12. The natural gas liquefaction process according to claim 10, further comprising thirdly compressing, after the additional pre-cooling, the third refrigerant part which additionally pre-cools the natural gas through the additional pre-cooling, wherein in the first mixing, the first, the second, and the third refrigerant parts respectively compressed through the first, second, and third compressing are mixed, and wherein the first refrigerant part and the second refrigerant part separated through the first separating and the third refrigerant part separated through the second separating, after being separated through the first separating and being separated through the second separating, pass through independent loops without being mixed with one another, and then mixed with one another in the first mixing.

13. The natural gas liquefaction process according to claim 12, wherein the additional pre-cooling includes: cooling the third refrigerant part separated through the second separating, through heat exchange in the first heat exchange region; expanding the cooled third refrigerant part; and heat-exchanging the expanded third refrigerant part and the natural gas in the first heat exchange region, to cool the natural gas.

14. The natural gas liquefaction process according to claim 12, wherein the additional pre-cooling includes: expanding the third refrigerant part separated through the second separating; and heat-exchanging the expanded third refrigerant part and the natural gas in the first heat exchange region, to cool the natural gas.

15. The natural gas liquefaction process according to claim 10, wherein the pre-cooling includes: cooling the first refrigerant part separated through the first separating, through heat exchange in the first heat exchange region; and expanding the cooled first refrigerant part, wherein the additional pre-cooling includes: cooling the third refrigerant part separated through the second separating, through heat exchange in the first heat exchange region; and expanding the cooled third refrigerant part, and wherein the first refrigerant part expanded through the expanding in the pre-cooling and the third refrigerant part expanded through the expanding in the additional pre-cooling, after being mixed with each other, cool the natural gas through heat exchange in the first heat exchange region.

16. The natural gas liquefaction process according to claim 1, further comprising:

secondly separating the refrigerant formed through the first mixing, into a third refrigerant part separated as a liquid phase refrigerant part and a fourth refrigerant part separated as a gas phase refrigerant part;

further compressing the fourth refrigerant part separated through the second separating;

cooling the further compressed fourth refrigerant part to be partially condensed; and after matching a pressure of the third refrigerant part separated through the second separating and a pressure of the first refrigerant part separated through the first separating to each other, secondly mixing the first and the third refrigerant parts, wherein in the first separating, the fourth refrigerant parts partially condensed through the further compressing and the cooling is the refrigerant that is separated into the first refrigerant part and the second refrigerant part, and wherein in the pre-cooling, the natural gas is pre-cooled in the first heat exchange region by using a fifth refrigerant part formed through the second mixing.

17. The natural gas liquefaction process according to claim 16, wherein in the second mixing, the pressures of the first and the third refrigerant parts are matched to each other by increasing the pressure of the third refrigerant part separated through the second separating or decreasing the pressure of the first refrigerant part separated through the first separating.

18. The natural gas liquefaction process according to claim 1, further comprising:

secondly separating the refrigerant formed through the first mixing, into a third refrigerant part separated as a liquid phase refrigerant part and a fourth refrigerant part separated as a gas phase refrigerant part;

further compressing the fourth refrigerant part separated through the second separating;

cooling the further compressed fourth refrigerant part to be partially condensed; and supplying the third refrigerant part separated through the second separating, to the first separating, wherein in the first separating, the fourth refrigerant part partially condensed through the cooling and the third refrigerant part supplied from the supplying are the refrigerant that is separated into the first refrigerant part and the second refrigerant part.

19. The natural gas liquefaction process according to claim 1, wherein in the first separating, the partially condensed mixed refrigerant is separated into the first refrigerant part and the second refrigerant part through a distillation column.

20. The natural gas liquefaction process according to claim 1, further comprising:

allowing the first refrigerant part which pre-cools the natural gas through the pre-cooling to flow into a third heat exchange region;

allowing the second refrigerant part which liquefies the natural gas through the liquefying to flow into the third heat exchange region; and partially condensing the refrigerant formed through the first mixing, through heat exchange in the third heat exchange region, to form the partially condensed mixed refrigerant, wherein the natural gas, before the pre-cooling, is preliminarily pre-cooled through heat exchange in the third heat exchange region, and wherein the first and second refrigerant parts which flow into the third heat exchange region and complete heat exchange respectively are compressed through the first compressing and second compressing, respectively.

21. The natural gas liquefaction process according to claim 1, wherein a refrigerant formed through the first mixing is partially condensed through heat exchange in the first heat exchange region, to form the partially condensed mixed refrigerant, and then the partially condensed mixed refrigerant is the refrigerant that is separated into the first refrigerant part and the second refrigerant part in the first separating.

22. The natural gas liquefaction process according to claim 21, wherein the pre-cooling includes: expanding the first refrigerant part separated through the first separating; and heat-exchanging the expanded first refrigerant part and the natural gas in the first heat exchange region to cool the natural gas.

* * * * *